US005946898A

United States Patent [19]

Kurata et al.

[11] Patent Number: 5,946,898

[45] Date of Patent: Sep. 7, 1999

[54] WIRE ROPE HAVING AN INDEPENDENT WIRE ROPE CORE

[75] Inventors: Mikio Kurata; Toshihiko Sabae; Hirofumi Ueki, all of Amagasaki, Japan

[73] Assignee: Shinko Kosen Kogyo Kabushiki Kaisha, Hyogo-ken, Japan

[21] Appl. No.: 08/901,512

[22] Filed: Jul. 28, 1997

[51] Int. Cl.[6] ..... D02G 3/36

[52] U.S. Cl. ..... 57/215; 57/210; 57/212; 57/213; 57/214; 57/218; 57/219; 57/220; 57/231

[58] Field of Search ..... 57/210, 212, 213, 57/214, 215, 216, 218, 219, 220, 231, 902, 9

[56] References Cited

U.S. PATENT DOCUMENTS

| | | | |
|---|---|---|---|
| 2,128,547 | 8/1938 | Wells | 57/212 |
| 2,181,341 | 11/1939 | Reardon | 57/148 |
| 3,729,921 | 5/1973 | Stroh | 57/145 |
| 4,244,172 | 1/1981 | Glushko et al. | 57/215 |
| 4,311,001 | 1/1982 | Glushko et al. | 57/9 |
| 4,454,708 | 6/1984 | Verreet | 57/9 |

FOREIGN PATENT DOCUMENTS

| | | | |
|---|---|---|---|
| 064258 | 11/1982 | European Pat. Off. . | |
| 3723720 | 2/1988 | Germany . | |
| 3940547 | 3/1991 | Germany | 57/214 |
| 3937588 | 5/1991 | Germany | 57/214 |
| 6-101181 | 4/1994 | Japan | 57/902 |

*Primary Examiner*—William Stryjewski
*Attorney, Agent, or Firm*—Jordan and Hamburg LLP

[57] ABSTRACT

A wire rope including a core rope having a number of strands each made of a number of wires, and a number of outer strands closed on the core rope. Each strand of the core rope has a contact section where two or more wires of the strand of the core rope come into contact with the closed outer strand. A total of contact section rates Tz is 20 percent or more of a circumference of a circumscribed circle of the core rope: Tz (%)=Ti/C×100, wherein Tl denotes a length of a circumferential component of the contact section, "C" denotes a length of the circumference of the circumscribed circle of the core rope. A non-contact section rate Gz is below 20 percent of the circumference of the circumscribed circle of the core rope: Gz (%)={100−(n×Tz)}/n, wherein "n" denotes the number of strands.

3 Claims, 6 Drawing Sheets

WIRE ROPE HAVING AN INDEPENDENT WIRE ROPE CORE

BACKGROUND OF THE INVENTION

This invention relates to a wire rope, in particular, to a wire rope having an independent wire rope core (hereinafter referred to as "core rope") and suitable for a running rope.

Running ropes require both a high strength and a high flexibility. For such running ropes, generally, the so-called IWRC wire ropes have been used. The IWRC wire rope uses an Independent Wire Rope Core (IWRC) into which a given number of strands are closed.

It should be noted that in this specification, the verb "strand" means to twist together a number of wires into a strand, and the verb "close" means to twist together a number of strands into a wire rope.

FIGS. 5A to 5D show a construction of a typical IWRC wire rope or IWRC 6×Fi(25) JIS Type-14. This IWRC wire rope includes a core rope 11 and six outer strands 14. Each outer strand 14 includes a center wire, six intermediate wires, six filler wires, and twelve outer wires. As shown in FIG. 5A, specifically, the core rope 11 is formed by closing seven strands 12 each having seven stranded wires 13. The six outer strands 14 are closed on the core rope 11. Such IWRC wire rope is used as a running rope for use in construction machines, cranes, well drilling machines, and the like.

In the conventional IWRC wire ropes, however, there have been the following problems. Outer strands 14 and the core rope 11 are likely to rub each other when being placed in operation, ausing wires of outer strands 14 or the core rope 11 to be worn out or bent, finally resulting in breakage of wires. Also, when a high pulling force or other external force is applied to the wire rope, strands 12 of the core rope 11 or wires 13 of a strand 12 displace one another due to the heavy load, and outer strands 14 move into a space between strands of the core rope 11, resulting in breakage of wires or a deformation of the core rope 11. These problems inevitably decrease the life of the wire rope.

The following can be considered to be causes of these problems. The core rope 11 which is formed by closing seven strands 12 each having seven stranded wires 13, as shown FIG. 5A, has six vertex-like projections and six big recesses in a cross section thereof. As shown in FIGS. 5B and 5D, the outer strands 14 closed on the core rope 11 are in point contact with the core rope 11. The vertex-like projection or the outermost wire 13 of the strand 12 receives the heaviest load when the heavy load is applied to the wire rope. Further, the core rope 11 has the biggest recesses in the outer periphery thereof. Accordingly, the strands 12 and wires 13 displace one another due to the heavy load, and outer strands 14 are consequently likely to move into recesses between strands 12 as shown in FIG. 5C. Also, as the strands 12 constituting the core rope 11 have generally round sections, and the wires 13 constituting the strand 12 have generally round sections, they are liable to move.

In view of these problems in the conventional IWRC wire ropes, there has been a demand for a novel IWRC wire rope having a high resistance to damages such as breakage of wires and deformation, and having a longer life.

SUMMARY OF THE INVENTION

It is an object of the present invention to provide a wire rope which has overcome the problems residing in the prior art.

According to one aspect of the present invention, there is provided a wire rope comprising: a core rope including a specified number of strands, each strand having a specified number of wires; and a specified number of outer strands closed on the core rope; wherein each strand of the core rope has such a flattened outside as to provide a contact section where two or more wires of the strand come into contact with the closed outer strand.

According to another aspect of the present invention, there is provided a method for manufacturing a wire rope, comprising the steps of: stranding a specified number of wires and a flexible core member into a strand; closing a specified number of strands into a core rope; stranding a specified number of wires into an outer strand; reducing the diameter of the core rope so that two or more of each strand of the core rope is operable to come into contact with the outer strand; and closing a specified number of outer strands on the reduced core rope.

With thus constructed wire rope, the closed outer strands come into contact with two or more wires of each of the strands constituting the core rope. Accordingly, the strand of the core rope can come into contact with or support the closed outer strand more stably than the conventional wire ropes in which a single wire of the strand constituting the core rope comes into contact with the closed outer wire, thus preventing displacement of wires or strands.

Further, the extended contact section reliably prevents the outer strand from moving into a space between strands of the core rope due to a heavy load.

These and other objects, features and advantages of the present invention will become more apparent upon a reading of the following detailed description and accompanying drawings.

DETAILED DESCRIPTION OF THE PREFERRED EMBODIMENT OF THE INVENTION

Figure 1A:
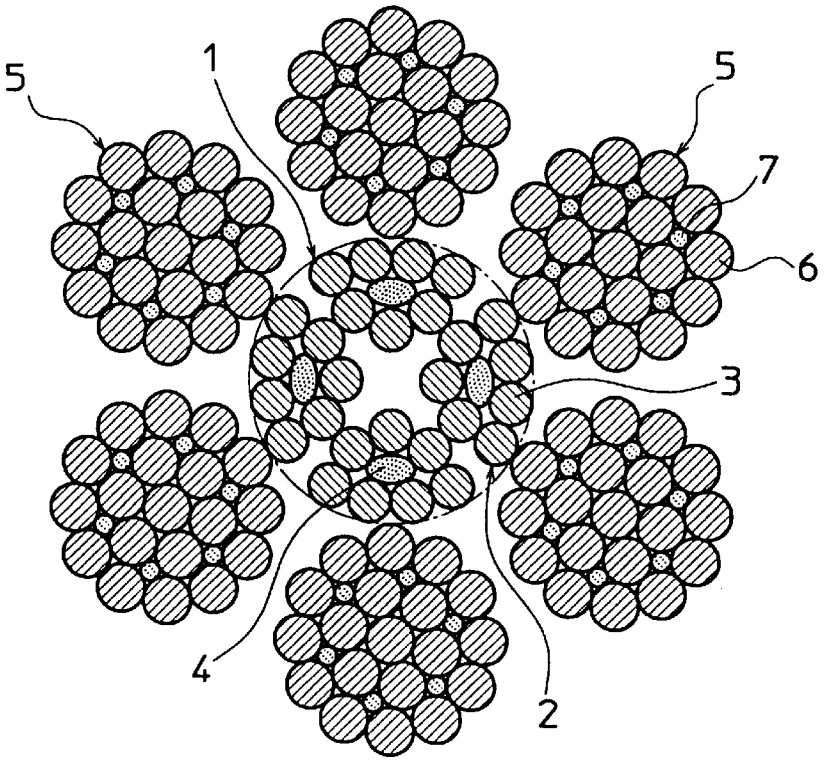
FIG. 1A is a diagram showing a cross section of an IWRC wire rope embodying the present invention.
Figure 1B:
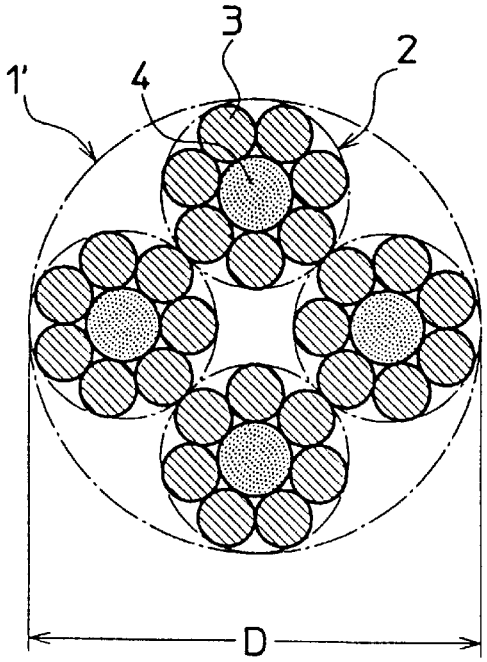
FIG. 1B is a diagram showing a cross section of a core rope for the IWRC wire rope, before being reduced in diameter.
Figure 1C:
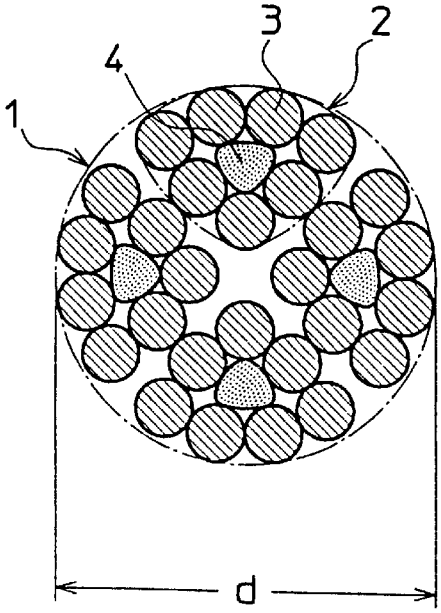
FIG. 1C is a diagram showing a cross section of a core rope for the IWRC wire rope, after being reduced in diameter.

A preferred embodiment of the present invention will be described with reference to drawings. FIG. 1A shows an IWRC wire rope embodying the present invention. FIG. 1B shows a core rope for the IWRC wire rope, the core rope without reduction in diameter. FIG. 1C shows a core rope for the IWRC wire rope, the core rope reduced in diameter.

The IWRC wire rope is of IWRC 6×Fi(25) JIS Type-14, and formed by closing six outer strands 5 on a core rope 1. The core rope 1 consists of closed four strands 2. Each strand 2 consists of a fiber core 4 and seven wires 3 stranded on the fiber core 4. Each outer strand 5 consists of a center wire, six intermediate wires, six filler wires, and twelve outer wires.

The core rope 1 is made by closing the four strands 2 to form an initial core rope 1', and then pressing outsides of the closed four strands 2 to reduce the diameter of the initial core rope 1' from D to d, as shown in FIGS. 1B and 1C. This diameter reduction makes the outside surface of the strands 2 closer to a circumscribed circle of the core rope 1.

Figure 2A:
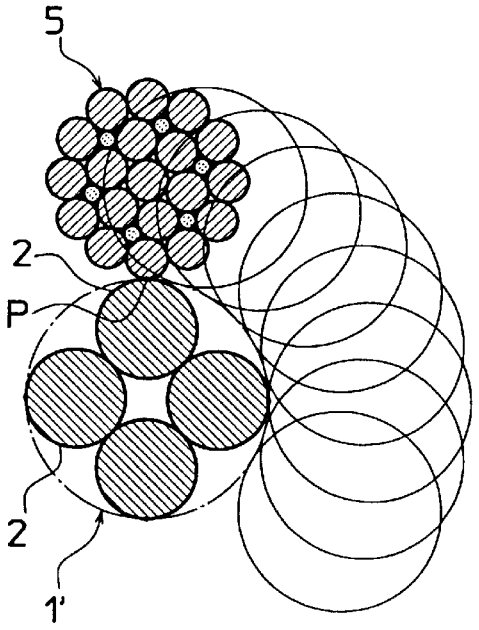
FIG. 2A is a diagram showing a contact state between a core rope without reduction in diameter and an outer strand.
Figure 2B:
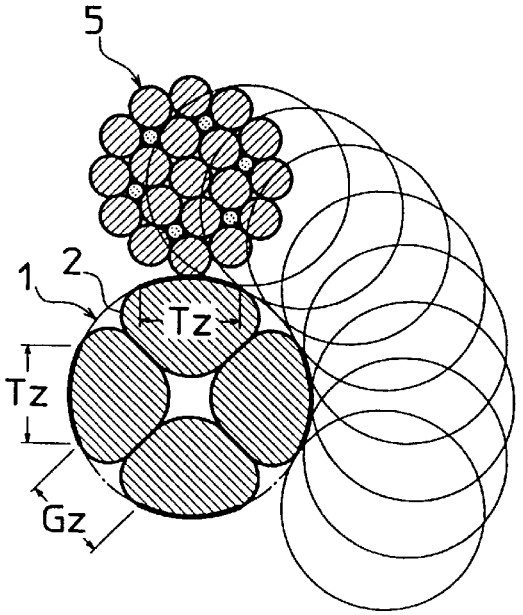
FIG. 2B is a diagram showing a contact state between a core rope with reduction in diameter and an outer strand.
Figure 2C:
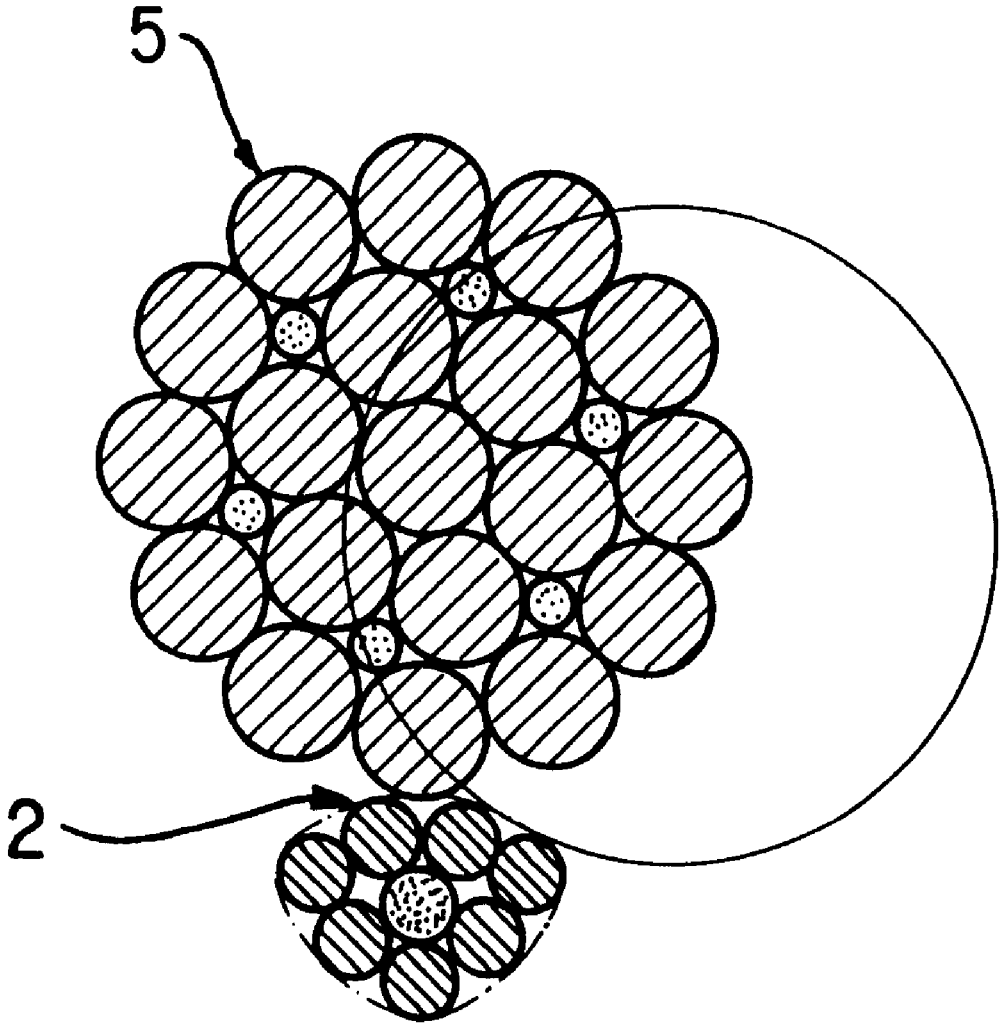
FIG. 2C is a diagram showing two core wires contacting the outer strand.

As shown in FIG. 2A, more specifically, in the case that the outer strands 5 are closed on the initial core rope 1' which has not been reduced in diameter, the core rope 1' and the outer strand 5 come into contact with each other at points P along a circumscribed circle of the initial core rope 1'. As shown in FIG. 2B, however, in the case that the outer strands 5 are closed on the core rope 1 which has been reduced in diameter, the core rope 1 and the outer strand 5 come into contact with each other in an extended contact section Tz along a circumscribed circle of the core rope 1. In other words, two or more wires 3 of the strand 2 come into contact with the closed outer strand 5 in the contact section Tz. This is further shown, for example, in FIG. 2C. In short, the former is the point contact while the latter is the line contact. Accordingly, the core rope 1 comes into contact with the outer strands 5 in an increased area, and thus receives a reduced load in an unit area because the load is distributed in a wider area.

Figure 3A:
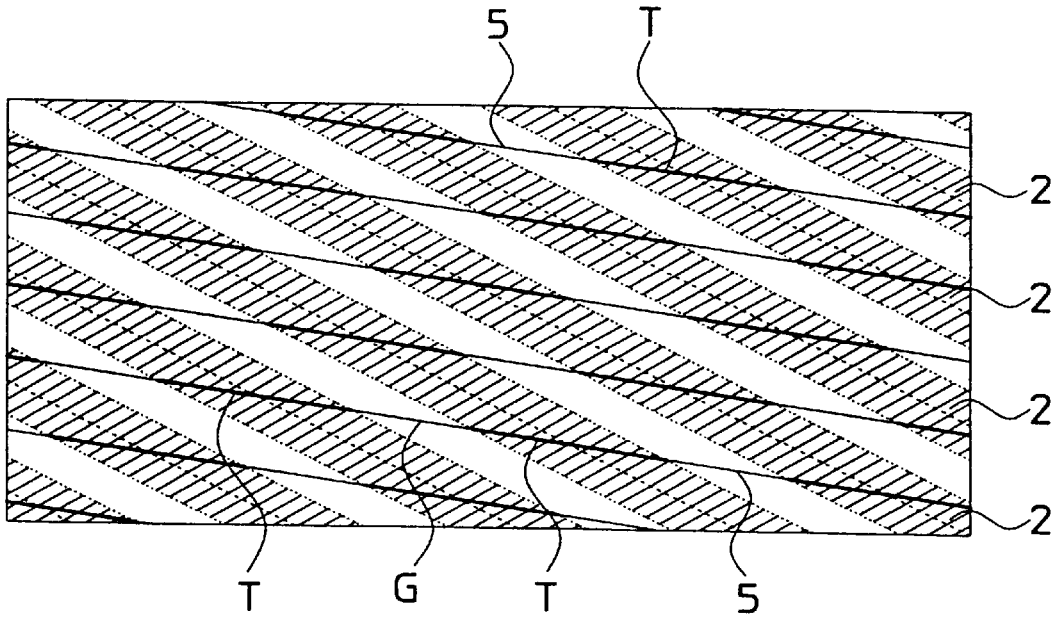
FIG. 3A is an unfolded diagram longitudinally showing a contact state between the core rope reduced in diameter and the outer strands in the IWRC wire rope of the present invention.

FIG. 3A is an unfolded diagram showing the contact state between the four strands 2 of the reduced core rope 1 and the six outer strands. This diagram more clearly shows that the strand 2 and the outer strand 5 are in contact with each other in a considerable long distance (contact section T) in a longitudinal direction of the wire rope. Indicated at G is a non-contact section where the core rope 1 is not able to come into contact with the outer strand 5. It will be seen that the contact section T is noticeably greater than the non-contact section G.

Figure 3B:
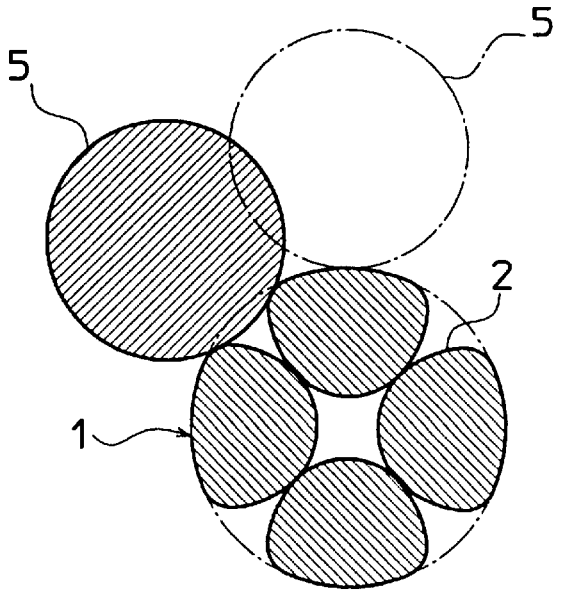
FIG. 3B is a cross-sectional diagram showing a contact state between the reduced core rope and the outer strand in the IWRC wire rope.

As shown in FIG. 3B, in other words, as the outside surface of the strands 2 become closer to the circumscribed circle, the recess between the strands 2 become smaller, and the non-contact section G becomes smaller, and the gap between respective supporting points of adjacent strands 2 becomes smaller. This consequently reduces the bending stress in the outer strand 5 and also prevents the outer strand 5 from moving into the recess between the strands 2.

Furthermore, the diameter reduction makes the internal space of the core rope 1 smaller as well as it changes the individual strand 2 from a circular shape to a substantially triangular shape in the cross section. Consequently, even when applied with a heavy load, the sliding movement among the individual strands 2 and wires 3 of the strand 2 decreases, which thus reduces the likelihood that the outer strand 5 moves into the recess between the strands 2. In this way, the pressure to wires is decreased by preventing the movement of outer strand into the recess and the wear in wires is decreased by preventing the movement of wires and strands, which thus prevents breakage of wires and irregularity in the rope shape.

The contact state between the core rope 1 and the outer strands 5 can be defined in the term of a ratio of the contact section length with respect to the circumference of the circumscribed circle of the core rope 1 or the inscribed circle of the outer strand 5 as follows.

In FIG. 2B, indicated as Tz is a contact section rate which is defined by Equation (1):

$$Tz(\%)=Tl/C\times 100 \quad (1)$$

Wherein Tl denotes a length of a circumferential component of the contact section, C denotes a length of the circumference of the circumscribed circle of the core rope 1 or the inscribed circle of the closed outer strand 5.

Also, indicated as Gz is a non-contact section rate which is defined by Equation (2):

$$Gz(\%)=\{100-(n\times Tz)\}/n \quad (2)$$

wherein n denotes the number of strands.

Figure 4A:
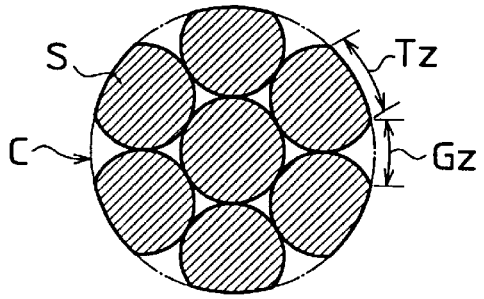
FIGS. 4A to 4C are diagrams showing a relationship between the number of strands constituting a core rope reduced in diameter, individual contact section rate, and individual non-contact section rate.
Figure 4B:
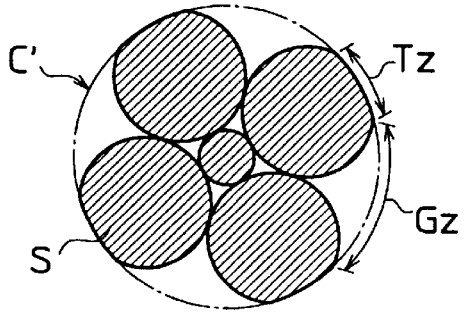
Figure 4C:
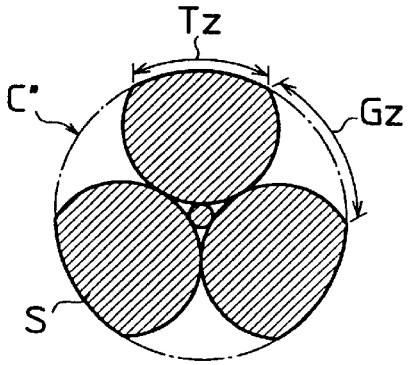
Figure 4D:
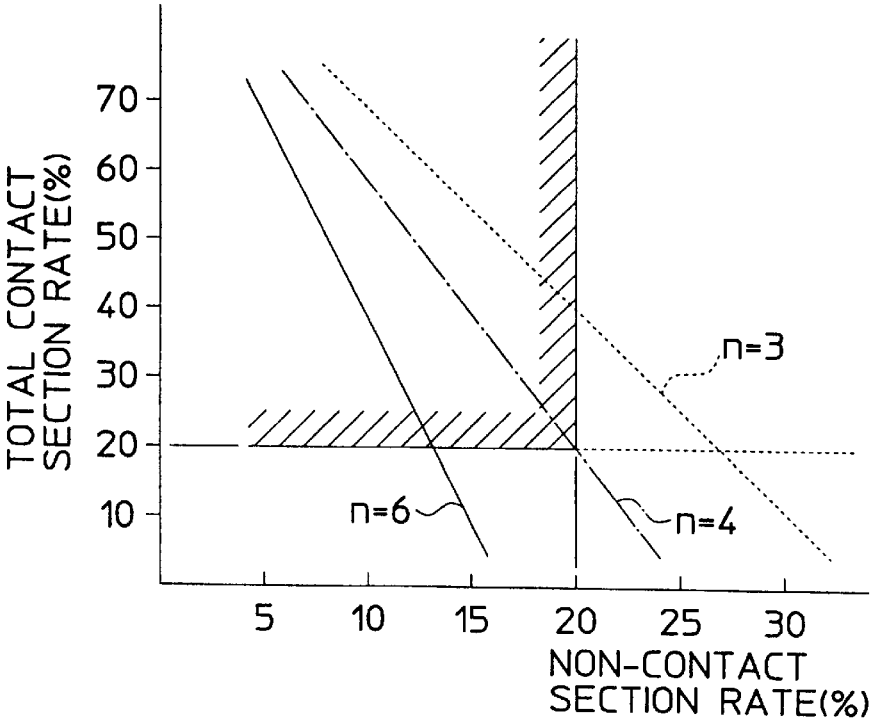
FIG. 4D is a graph showing a relationship between a total of contact section rates and a rate of a non-contact section, the number of strands of a core rope being parameter.

FIGS. 4A to 4C diagrammatically show a relationship between the number of strands (n) constituting a reduced core rope and the contact section rate Tz and the non-contact section rate Gz. As shown in FIGS. 4A to 4C, the contact section rate Tz and the non-contact section rate Gz vary with the number of strands of a reduced core rope even in the same reduced diameter. FIG. 4D is a graph showing a relationship between a total of contact section rates Tz and a rate of a non-contact section Gz, the number of strands (n) of the core rope being a parameter.

It will be seen from the graph that in the case of a smaller number of strands, e.g., n=3, even when the total contact section rate is made to be low, e.g., lower than 20 percent, the non-contact section rate is relatively high, e.g., higher than 27 percent. The higher the non-contact section rate becomes, the larger the gap between supporting points of the adjacent strands becomes, which consequently increases the bending stress in the outer strand and increases the possibility of breaking in the outer strand Accordingly, conditions of attaining the above-mentioned advantageous effects of the reduced core rope can be defined in the term of total contact section rate and non-contact section rate. Specifically, it may be preferable that the total contact section rate is 20 percent or more and each non-contact rate is smaller than 20 percent.

Next, characteristics of the inventive IWRC wire rope will be specifically described based on comparison with a conventional IWRC wire rope.

An inventive IWRC wire rope was made as follows. As shown in FIG. 1B, an initial core rope 1' was made by closing four strands each having a fiber core 4 and seven wires 3. The initial core rope 1' had a diameter of 5.8 mm. The initial core rope 1' was passed through a die to form a core rope 1 having a diameter of 5.4 mm as shown FIG. 1C. It is also possible to reduce the diameter of the core rope by swaging. Thereafter, six outer strands 5 were closed on the core rope 1 to form a wire rope having a diameter of 14.7 mm and a rope pitch of 87 mm. The outer strand 5 has a center wire, six intermediate wires, six filler wires, and twelve outer wires.

The reduction die has a reduction rate of about 13 percent. The reduced core rope 1 has a total of contact section rates Tz of about 56 percent and a non-contact section rate Gz of about 11 percent. This inventive wire rope has a breaking strength of 137 kN.

Figure 5A:
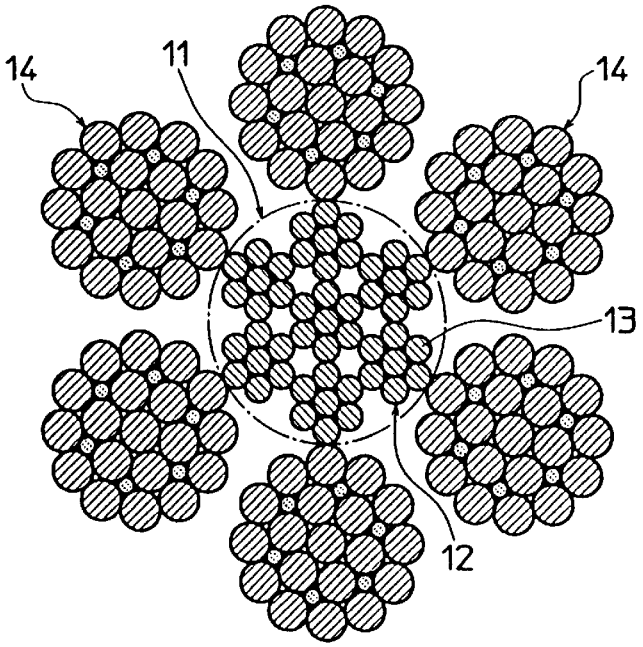
FIG. 5A PRIOR ART
FIG. 5A is a diagram showing a cross section of a conventional IWRC wire rope.
Figure 5B:
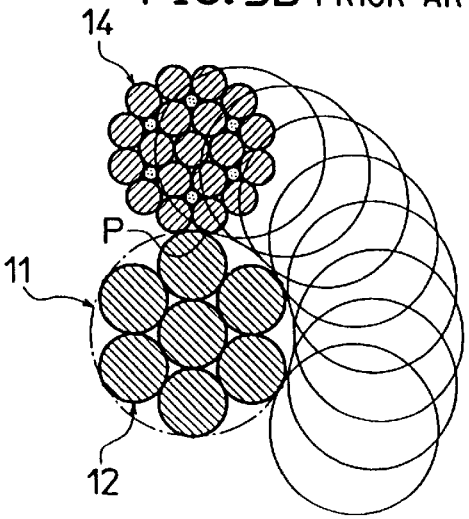
FIG. 5B PRIOR ART
FIG. 5B is a diagram showing contacts between a core rope and an outer strand in the conventional IWRC wire rope.
Figure 5C:
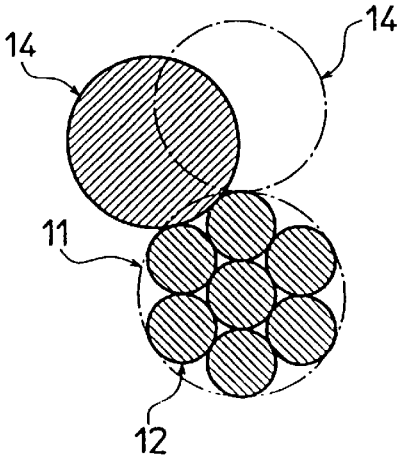
FIG. 5C PRIOR ART
FIG. 5C is a diagram showing another contacts between the core rope and the outer strand in the conventional IWRC wire rope.
Figure 5D:
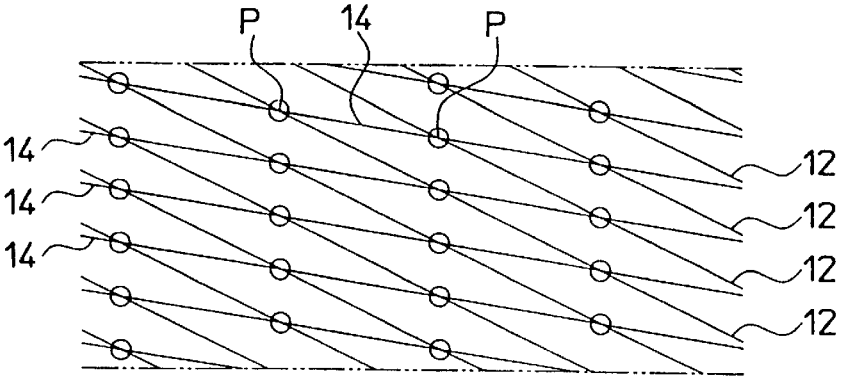
FIG. 5D PRIOR ART
FIG. 5D is an unfolded diagram longitudinally showing contacts between the core rope and the outer strands in the conventional IWRC wire rope.

As a comparative example, on the other hand, a conventional IWRC wire rope was made which has the same diameter (=14.7 mm) and the same rope pitch (=87 mm). However, this comparative wire rope has the core rope 11 as shown in FIG. 5A but does not have the reduced core rope 1 as shown in FIG. 1A. This comparative wire rope has a breaking strength of 141 kN.

The following bending fatigue test was carried out for the above-made inventive and conventional IWRC wire ropes:

Diameter of Sheave for Bending Test: 240 mm
Ratio of Bending Diameter to Rope Diameter: 18
Tension for Rope: 27kN
Safety Factor: 5
Bending Type: S bending
Contact Angle: 180°×twice
Stroke: 1200 mm
Number of Bending: 12000

TABLE-1 shows the number of broken wires. TABLE-2 shows diameters of wire ropes before and after testing.

TABLE 1

| Location | Inventive Wire Rope | Comparative Wire Rope |
|---|---|---|
| Outer Strands | | |
| Outside Wires | 57 | 59 |
| Inside Wires | 0 | 53 |
| Total | 57 | 112 |
| Core Rope | 50 | 160 |

TABLE 2

| Before or After Test | Diameter of Inventive Wire Rope (mm) | Diameter of Comparative Wire Rope (mm) |
|---|---|---|
| Before Test | 14.7 | 14.7 |
| After Test | | |
| Loaded | 14.3 (−2.7%) | 14.2 (−3.4%) |
| Unloaded | 14.5 (−1.4%) | 14.3 (−2.7%) |

It will be seen from TABLE-1 that in the aspect of the number of broken wires and the breaking location, the inventive wire rope is better than the comparative wire rope. In particular, in the aspect of the breaking location, the inventive wire rope can be seen to be remarkably better than the comparative wire rope, that is, the broken wire number of the inventive wire rope is much lower at inside wires of the outer strands and at the core rope than that of the comparative wire rope.

Also, it will be seen from TABLE-2 that the diameter reduction of the inventive wire rope is smaller than that of the comparative wire rope in not only at the unloaded condition but also at the loaded condition.

Accordingly, a wire rope of the present invention can be concluded to have an excellent resistance to wire breaking and wire displacement.

The foregoing embodiment is directed to the IWRC 6×Fi(25) JIS Type-14 wire rope which includes a core rope having four strands each consisting of a fiber core and seven wires, and six outer strands each consisting of a center wire, six intermediate wires, six filler wires, and twelve outer wires. However, the present invention is not limited to such IWRC 6×Fi(25) JIS Type-14 wire ropes, but is applicable to a variety of wire rope as far as the diameter of the core rope can be reduced in such a manner that the outside surface of strands constituting the core rope becomes closer to a circumscribed circle of the core rope to increase the contact section and decrease the non-contact section.

Further, the present invention makes it possible to produce novel wire ropes having higher strength and flexibility by changing the construction of a core rope, e.g., the diameter of wire, the number of wires, the number of strands, the diameter reduction rate, to increase the contact section rate.

It should be noted that the diameter reduction rate of the foregoing embodiment is recited as a preferable example in consideration of the number of strands. According to the present invention, the advantageous effects of the present invention can be obtained as far as the diameter reduction rate ensures a total contact section rate of 20 percent or more. To keep the bending stress of outer strands small, however, it may be preferable to regulate the diameter reduction rate so that the non-contact rate Gz is under 20 percent, in particular, in the case of a small number of strands of the core rope.

Moreover, in the foregoing embodiment, the fiber core 4 is used as a center of the strand 2 of the core rope 1. According to the present invention, however, any other material than fiber core may be used as a center of a strand constituting a core rope as far as it has a necessary strength and a deformability to enable the diameter reduction, e.g., fiber rope, rubber core.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A wire rope comprising:

a core rope including a plurality of core strands, each core strand having a plurality of core strand wires; and a plurality of outer strands twisted together to surround the core rope, each of said outer strands including a plurality of outer strand wires;

each core strand of the core rope having such a flattened outside so as to provide a contact section where two or more core strand wires of at least one core strand come into contact with one of said outer strand wires of a juxtaposed outer strand;

said core rope having a total number of contact sections corresponding to the number of core strands such that the total of the contact sections Tz is 20 percent or more of the circumference of a circumscribed circle of the core rope, the contact section Tz being defined by the following equation:

$$Tz(\%)=Tl/C\times 100$$

wherein TI denotes the circumferential component of the contact section and C denotes the circumference of the circumscribed circle of the core rope.

2. A wire rope according to claim 1, wherein the core rope further has a plurality of non-contact sections where no core strand wires of the core strands of said core rope come into contact with the juxtaposed outer strand such that a non-contact section rate Gz is below 20 percent of the circumference of the circumscribed circle of the core rope, the non-contact section rate Gz being defined in Equation (2):

$$Gz(\%)=\{100-(n\times Tz)\}/n \quad (2)$$

wherein n denotes the number of the core strands.

3. A wire rope comprising:

a core rope including a plurality of core strands, each core strand having a plurality of wires; and a plurality of outer strands twisted together to surround the core rope, each of said outer strands including a plurality of outer strand wires;

each core strand of each core rope having such a flattened outside as to provide a contact section where two or more core strand wires of of at least one core strand come into contact with one of said outer strand wires of a juxtaposed outer strand;

said core rope further having a number of non-contact sections where no core strand wires of the core strands of the core rope come into contact with the outer strand wires of any outer strand such that a non-contact section rate Gz is below 20 percent of the circumference of the circumscribed circle of the core rope, the non-contact section rate Gz being defined by the following equation:

$$Gz(\%)=\{100-(n\times Tz)\}/n$$

wherein n denotes the number of the core strands.

* * * * *